United States Patent [19]

Funaioli et al.

[11] 4,177,907

[45] Dec. 11, 1979

[54] SHIPPING CONTAINER

[75] Inventors: Ettore Funaioli, Bologna; Alfio Rossetti, Busto Arsizio; Pier C. Landini, Castellanza, all of Italy

[73] Assignee: Euteco S.p.A., Milan, Italy

[21] Appl. No.: 947,316

[22] Filed: Sep. 29, 1978

[30] Foreign Application Priority Data

Sep. 30, 1977 [IT] Italy ..... 28134 A/77

[51] Int. Cl.[2] ..... B65D 7/26

[52] U.S. Cl. ..... 220/1.5; 217/14; 220/6; 222/182; 222/559

[58] Field of Search ..... 220/6, 7, 1.5; 217/15, 217/14; 214/307; 222/182, 561, 559

[56] References Cited

U.S. PATENT DOCUMENTS

| | | | |
|---|---|---|---|
| 578,445 | 3/1897 | Cobleigh | 217/14 X |
| 701,551 | 6/1902 | Edwards | 222/561 X |
| 724,346 | 3/1903 | Smith | 222/561 X |
| 989,074 | 4/1911 | Stall | 217/15 |
| 1,114,860 | 10/1914 | Colombot | 217/15 |
| 1,249,617 | 12/1917 | Griffin | 222/561 |
| 2,887,251 | 5/1959 | Mackridge | 220/1.5 X |
| 3,570,698 | 3/1971 | Dougherty | 217/15 X |
| 3,602,388 | 8/1971 | Harkamp | 220/6 X |
| 4,099,640 | 7/1978 | Nessfield | 220/1.5 X |

FOREIGN PATENT DOCUMENTS

| | | | |
|---|---|---|---|
| 1804162 | 9/1970 | Fed. Rep. of Germany | 220/1.5 |
| 905521 | 12/1945 | France | 217/14 |
| 230821 | 1/1944 | Switzerland | 217/14 |

*Primary Examiner*—Allan N. Shoap

*Attorney, Agent, or Firm*—Sughrue, Rothwell, Mion, Zinn and Macpeak

[57] ABSTRACT

The end walls of the container are hinged to the opposite vertical edges of one side wall. The roof is hinged to a longitudinal listel rigid with said one side wall, inwardly protruding from the longitudinal upper edge of the latter at 90°, and is disengageably coupled with a similar listel on the longitudinal upper edge of the other side wall. Both side walls have their longitudinal lower edges hinged to the base wall of the container, the said one side wall being hinged at a level lower than that of the hinges of the other side wall. The container is collapsable to a reduced volume by first folding the end walls onto the inner face of said one side wall, subsequently downwardly folding the roof onto the folded end walls, then downwardly folding onto the base wall said one side wall with its carried end walls and roof, and downwardly folding the other side wall onto the said one side wall. To this end, a basic section of an upright is provided at each corner of the base wall, and a corresponding extension section of the upright is provided at each vertical edge of the side walls.

2 Claims, 17 Drawing Figures

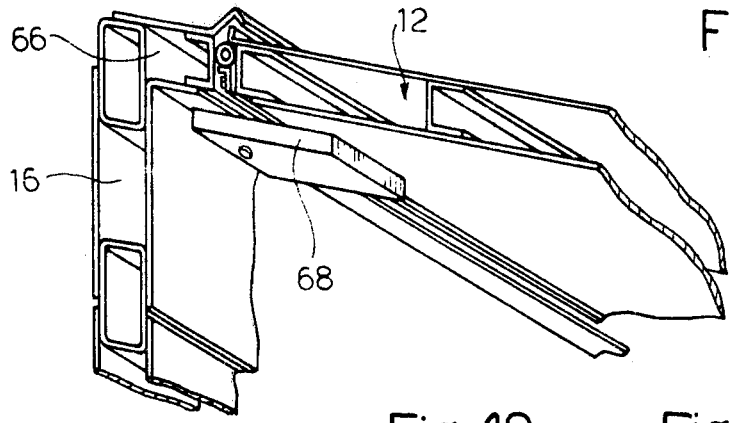
Fig. 12
Fig. 13
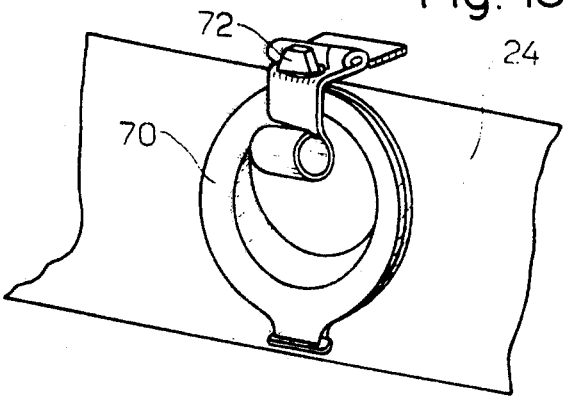
Fig. 14
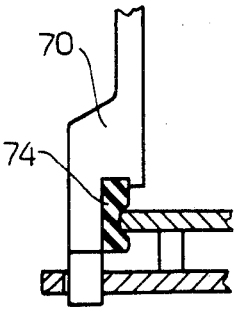
Fig. 15
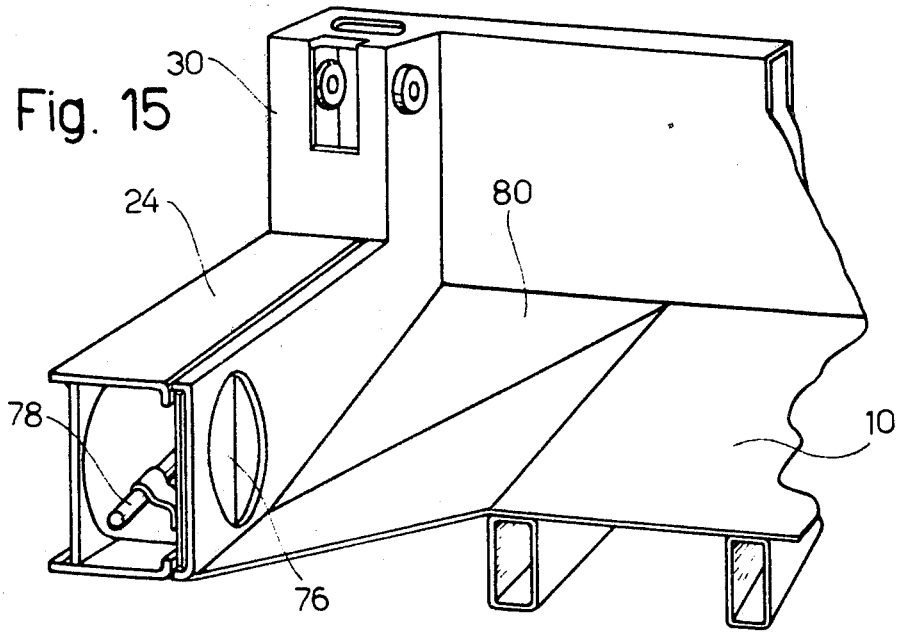

SHIPPING CONTAINER

The present invention relates to a shipping container for the transport of goods on road vehicles, railway trucks and container ships.

Rigid shipping containers are known in the art which are of parallelepipedal form, formed by a base wall, a rectangular roof wall, two rectangular side walls and two end walls, these last mentioned walls having one or more doors for access to the inside of the container. The dimensions of said containers are regulated by international rules.

Rigid containers occupy the same space when empty as when full, with resultant disadvantages in their transport and storage. Recourse has therefore been made to containers having walls articulated together, that may be folded in order to occupy a space which, at present, is typically equal to a quarter of that occupied by the container in its erected condition. Collapsible containers are for example those having side and bottom walls hinged to the base wall, thus being capable of being folded towards the base wall. However, the roof is not hinged and as a result during both the folding down operation and erection, the roof must be completely disengaged from the other walls which form the container. A consequence of this is that the said operations are length and unsafe and the overall structure of the container is not sufficiently rigid.

In other containers of known type the folding down characteristic is bestowed by the side walls being constructed each in the form of two complemental wall panels hinged together along an axis parallel to the base wall of the container. In folding down such container the two side walls are folded one onto the other and onto the base wall of the container. The disadvantages of this solution are those which derive from the reduced overall rigidity of the container and from the increased length of the dividing surfaces between the walls. This circumstance implies a larger quantity of required seals with an increased expenditure and with less guarantee, in fact, of waterproofing.

The object of the present invention is to overcome the drawbacks in the prior art relating to collapsible containers.

More particularly, the container of the present invention, rigid, collapsible and of parallelepipedic form, has a base wall, a roof, a pair of side walls and a pair of end walls and is characterized in that:

the rectangular base wall is fitted on its periphery with a strengthening frame and is provided at each of its four angles with a basic upright section terminating at its upper end by a rest surface on which, when the container is erected, an extension upright carried by the corresponding side walls comes to rest in vertical alignment;

the two end walls are hinged to opposite vertical edges of one of the side walls;

the roof is hinged at one of longitudinal sides to the side wall to which the end walls are hinged, by hinges carried by a longitudinal listel rigid with the wall and forming with the latter an angle of 90°, the width of said listel being not less than the thickness of the end walls, the roof also being disengageably coupled, in erected condition of the container, to the other side wall, by means of a listel rigid with said wall and forming with the latter an angle of 90°;

the side wall carrying the end walls and the roof is hinged to the base wall at a height less than that of the hinge of the other side wall, the difference in height being not less than the thickness of the upright; in such a way that the folding down of the erected container is only possible by the following successive operations:

folding the end walls inwardly onto the side wall to which they are hinged;

folding the roof downwardly onto said folded end walls, folding the said side wall onto the base together with the end walls and with the roof folded onto the side wall itself, folding the other side wall onto the first one, all the folding movements entailing a rotation of 90° and being carried out towards the inside of the container.

In containers of the present invention, in contrast to containers of the prior art, the number of rigid walls forming the container itself is reduced to a minimum. Therefore in comparison with containers formed by sectional walls comprising wall sections linked together by hinges, than of the present invention offers better characteristics as regards rigidity and, since the matching surface between the walls and the number of corresponding seals are reduced to a minimum, offers greater guarantee of hermeticity. It also has economic advantages on account of the reduced quantity of seals required.

Moreover, in contrast to the majority of containers of known type, that of the present invention has all its walls connected together by means of hinges and thus in the folding down operation, as in the reverse one of erection, no wall is completely freed from the remaining ones. The manoeuvres consequently become quicker and safer and the structure of the container assumes greater rigidity in comparison with those containers in which one or more walls have to be detached completely.

The container of the present invention when folded down occupies an appreciably reduced space in relation to that occupied when full. In general four folded down empty containers may be stacked in the space occupied by one full container, taking into account also the hollow spaces which must be provided between the folded containers to enable their mutual locking in the stack.

The container of the present invention may be fitted with a door at one or both end walls. It may also be provided with openings in the roof and in the base wall, the first destined for the loading of bulk material by means of a hopper, the second for the discharge of said material.

The invention will now be illustrated with reference to the appended drawings in which:

FIG. 12 illustrates a safety lock of the roof to the side wall opposite that carrying the hinges;

FIG. 13 shows the discharge porthole in perspective view;

FIG. 14 is a cross-sectional view of the porthole;

FIG. 15 illustrates details relating to the discharge zone, on the inside of the container;

Figure 1:
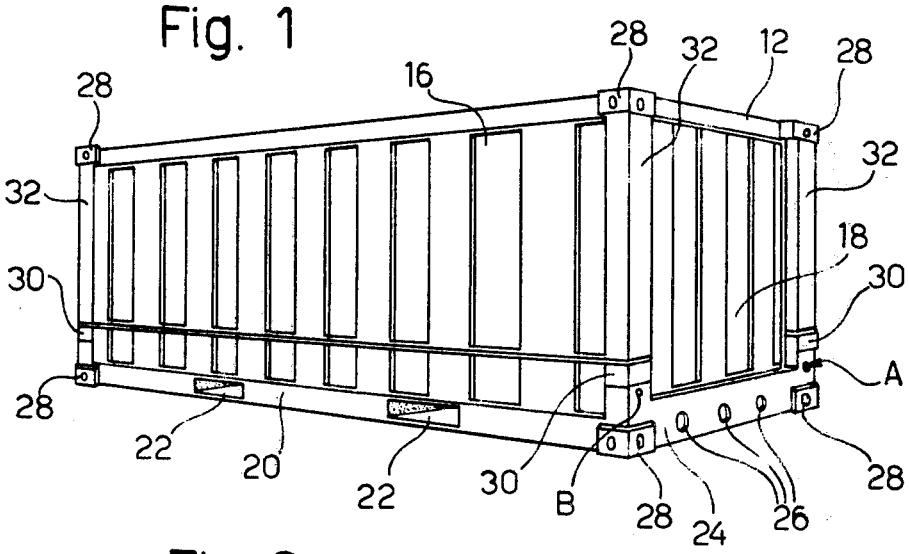
FIG. 1 shows in perspective view the container in its erected form.

In FIGS. 1 to 5, reference 10 indicates the base wall, 12 the roof, 14 and 16 the side walls and 18 the end walls of the container.

The base wall 10 is provided round its periphery with a strengthening frame in the long sides of which (side members 20) openings 22 are provided for the passage of the fork of a lifting truck. The short sides of the frame (end members 24) are provided portholes 26 for the discharge of bulk material.

Said portholes 26 are provided with shutters and valves that may be regulated from outside as will be described in detail further on.

The base wall 10 is provided at each of its four corners with an angle block 28, rigid with a basic upright section 30. When the container is erected extension uprights 32 come to rest on the upper ends of the basic upright section 30, similar in cross-sectional shape and integral with the side walls 14 and 16.

Further angle blocks 28 are provided at the four upper corners of the container.

The function of the angle blocks is to enable hooking up for transport and stacking operations. The dimensional characteristics of such blocks are fixed by international rules.

FIG. 1 shows the container of the present invention in its erected form. In folding down such a container one proceeds by first folding the end walls inwardly onto the side walls to which they are hinged. Thus, referring to FIG. 2, each end wall 18 rotates through 90° about a vertical axis passing through C and D until it abuts against the side wall 14. At C and D the hinges are positioned that connect the respective end wall 18 with the side wall 14. Subsequently the roof in folded onto the already folded end walls.

Figure 3:
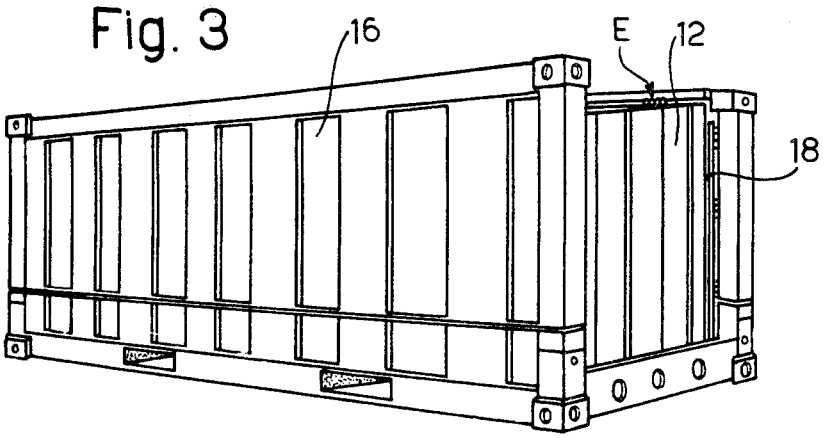

Thus referring to FIG. 3 the roof 12 rotates downwardly through 90° around a horizontal axis passing through E and parallel to the base of the container, until it abuts against the already folded end walls 18. At E is placed one of the hinges which connects the side wall 14 with the roof 12. The roof 12 is hinged to the side wall 14 indirectly by means of a longitudinal listel 52 (FIG. 10) rigid with the wall itself and forming with the latter an angle of 90°. The width of such listel is not less than the thickness of each of the end walls 18. The listel enables the rotation of the end walls 18 without interference of the same with the hinges which link the roof 12 to the side wall 14 and also enables folding of the roof 12 with formation of a space between the roof itself and the side wall 14, said space housing the end walls 18.

Figure 4:
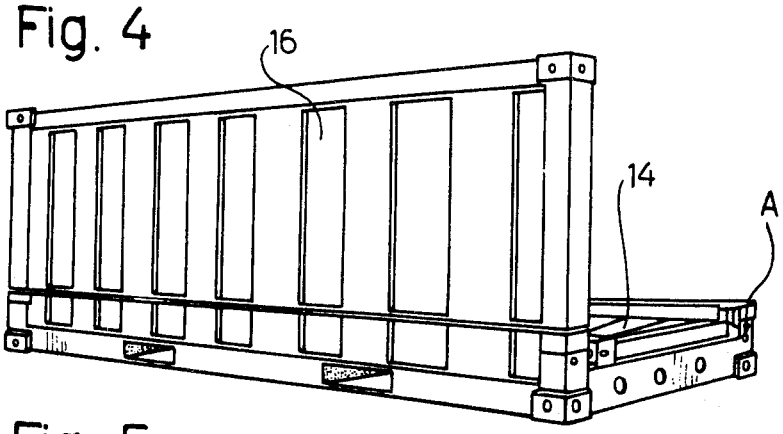
Figure 5:
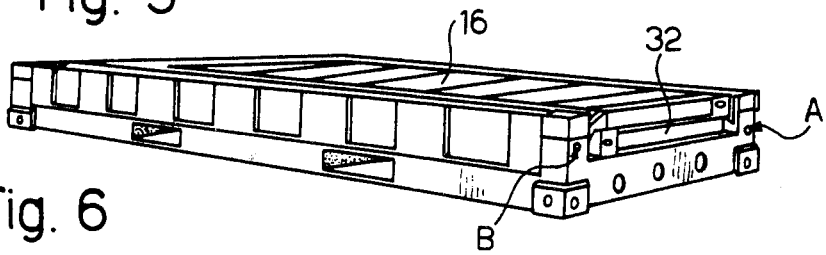

The next folding down manoeuvre entails folding onto the base wall 10 the side wall 14, onto which end walls 18 and roof 12 have been previously folded, as illustrated in FIG. 4. In particular, the side wall 14 rotates inwardly through 90° around a horizontal longitudinal axis passing through A and parallel to the base wall of the container. Said axis is placed at a height in relation to base wall 10 which is less than that of a horizontal longitudinal axis passing through B parallel to said base and which forms the rotation axis of the other side wall 16. The difference between the two heights is not less than the thickness of the extension uprights 32. This circumstance makes possible the subsequent rotation through 90° of said other wall 16 down onto the already folded wall 14, the whole being illustrated in FIG. 5. In this manner the complete folding down of the container is achieved.

Figure 7:
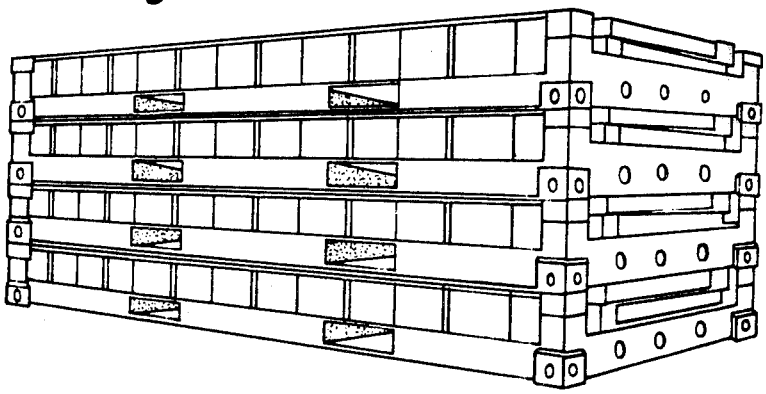
FIG. 7 shows in perspective view four containers folded down and stacked.

With the adopted solution, given the position of the axis of the hinges and the sequence of the folding down operations, the bulk volume of the container when folded down is typically less than 25% of the volume occupied by the erected container. FIG. 7 thus shows four stacked containers, which may be locked to one another by means of convenient mechanical locking devices.

Figure 2:
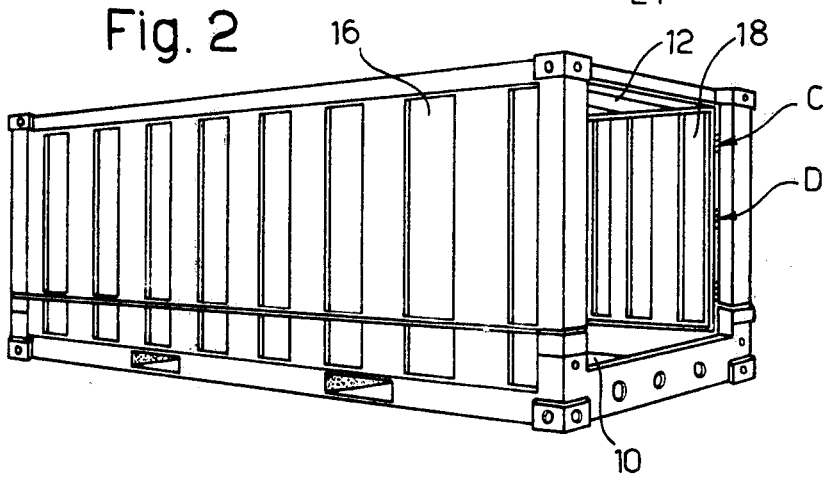
FIGS. 2 to 5 illustrate in perspective view the subsequent steps in the folding of the container until it is completely folded down.

The container of the present invention enables the intervention of a crane to be reduced to a minimum in the folding down operations, as in the reverse ones of erection. A crane is required, in fact, for the manoeuvres illustrated in FIGS. 3, 4 and 5. The manoeuvre illustrated in FIG. 2 is carried out manually.

Figure 6:
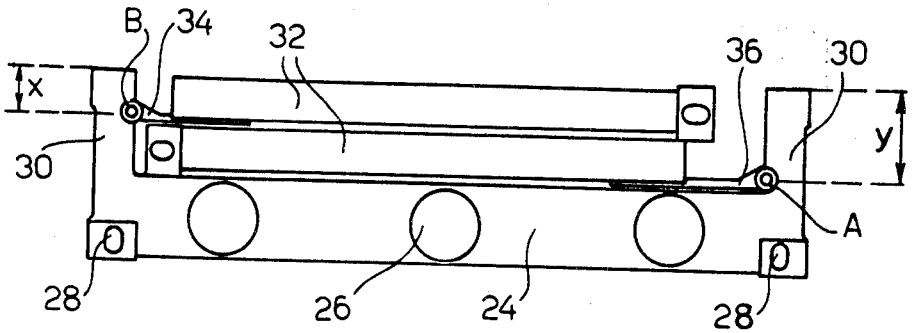
FIG. 6 shows some details relating to the folding of the side walls onto the base wall of the container.

FIG. 6 shows in end view the container of the present invention completely folded. In this Figure the transverse end member 24 is shown, forming part of the strengthening frame, in which are fashioned the openings 26 for the discharge of bulk material. A and B indicate the rotation axis of the side walls, these last being folded and being in contact one with another by means of the respective extension uprights 32.

As shown in FIG. 6 the axis A is located at a distance y and the axis B at a distance to x from the upper end surfaces of the basic upright sections 30. The difference $y-x$ is equal, in the case illustrated, to the thickness of the extension uprights 32. The side walls of the container are articulated to the base wall at the basic upright sections 30 and references 34 and 36 in FIG. 6 indicate the respective hinges.

Figure 8:
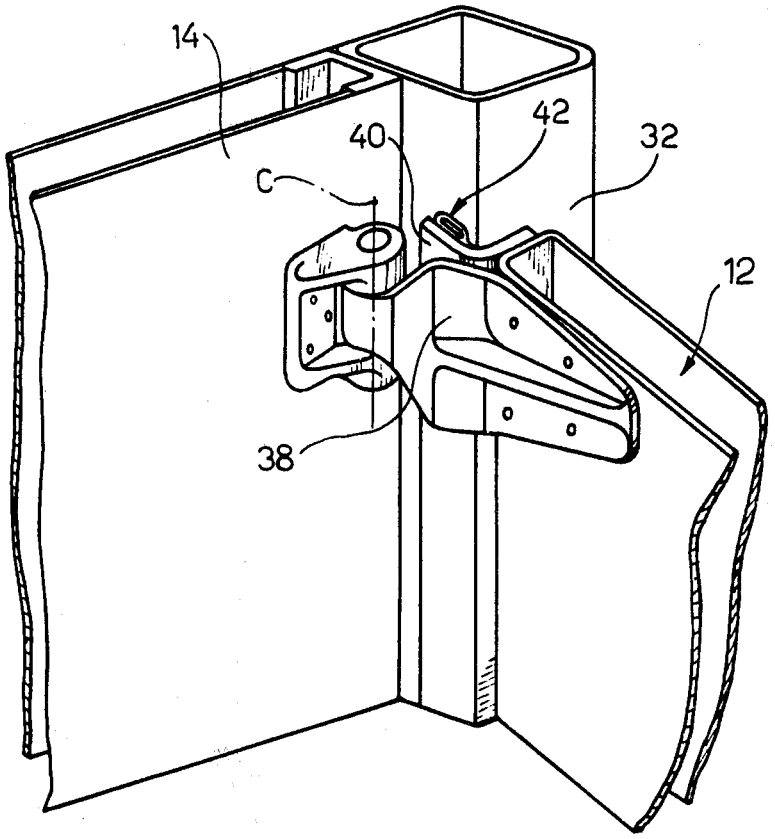
FIG. 8 illustrates an articulation between an end wall and a side wall of the container.

The hinges may be designed in such a manner as to give the foldable walls combined displacements consisting of a rotation around a virtual axis lying on the sealing surface and a translation, thus enabling the folding down of the container into a small volume in the most compact possible. For this purpose, in FIG. 8 the connecting hinge 38 between the end wall 18 and the side wall 14 has its effective axis of rotation C displaced in relation to the surfaces onto which the said walls come into sealing contact one with another. In said Figure numeral 32 indicates the extension upright fixed to the side wall 14, numeral 40 an L-profile of metal numeral 42 indicates a sealing strip interposed between said profile and the extension upright 32.

Figure 9:
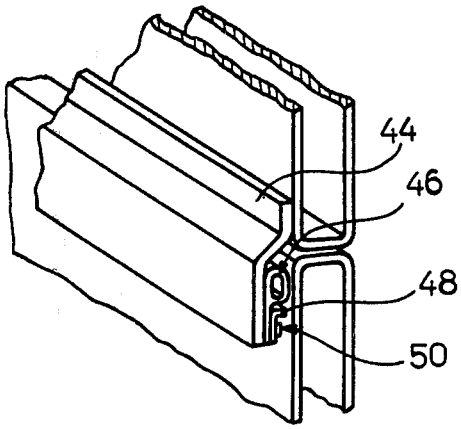
FIG. 9 illustrates details relating to the positioning of the seals between the ends of two adjoining walls.

The positioning of a sealing strip along the contact zone between two adjoining walls is illustrated in FIG. 9. According to said Figure in correspondence with the contact zone of the walls, a support strip 44 is applied to the inside of the container to which a sealing strip 46 is fixed by means of metal strap 48 and by screws 50. Said sealing strips, placed in correspondence with the contact surfaces between the base, side and end walls, are designed in such a way that the pressure of the bulk material in the container promotes the sealing effect of the strips.

Figure 10:
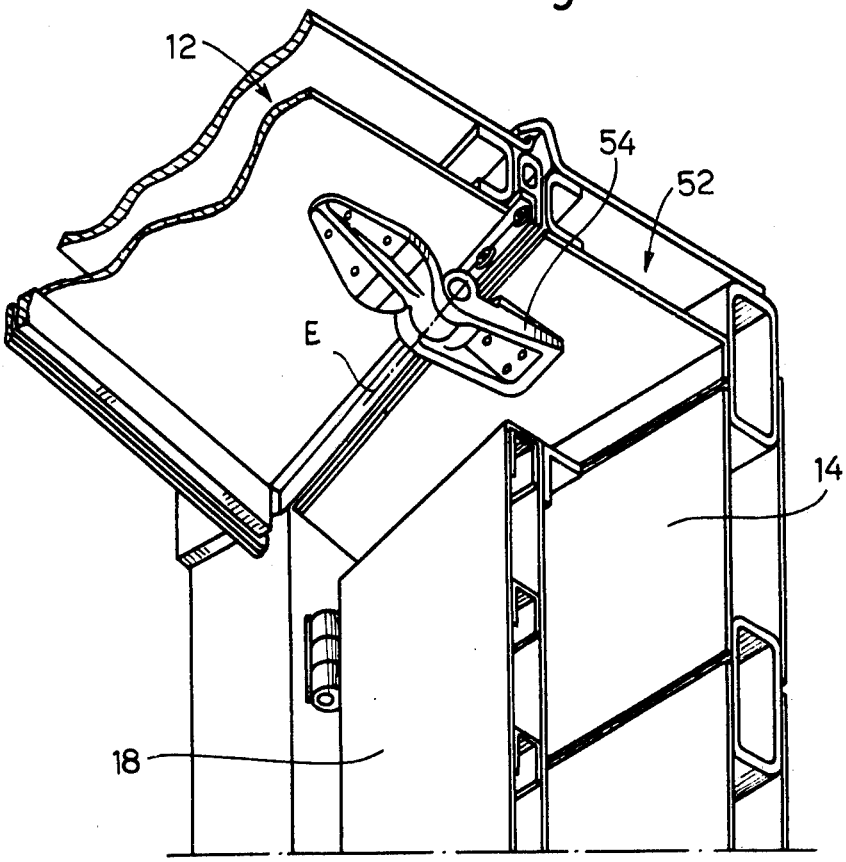
FIG. 10 illustrates an articulation between the roof and a side wall of the container.

FIG. 10 illustrates the connection of the roof 12 to the side wall 14 by means of a rigid, inwardly directed listel 52, rigid with the wall 14 and forming with the latter an angle of 90°. Reference 54 indicates a hinge, which enables the roof to rotate around axis E. When roof 12 is rotated through 90° downward a free space forms between the roof itself and the side wall 14, which houses the end wall 18 already folded onto said wall 14.

Figure 11:
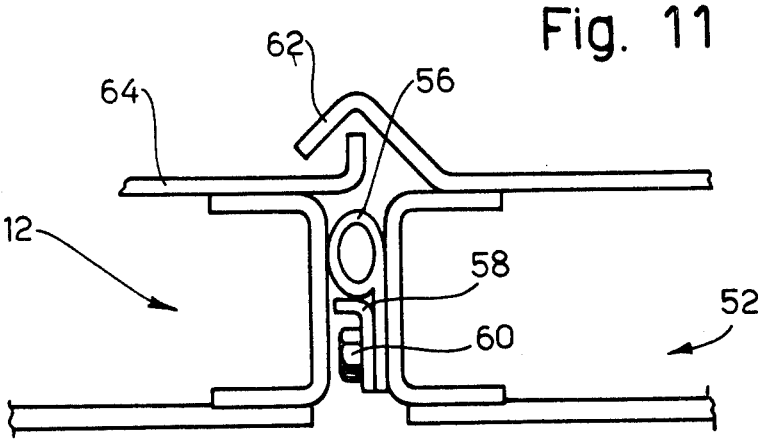
FIG. 11 illustrates an enlarged detail relating to the embodiment of FIG. 10.
Figure 16:
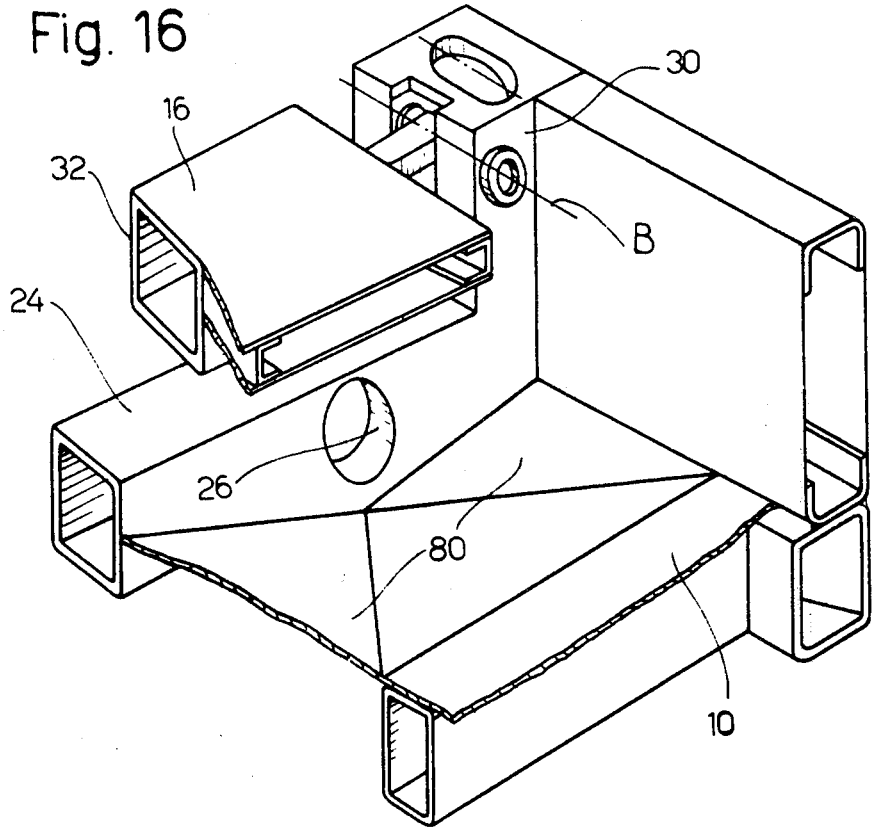
FIG. 16 illustrates details on the inside of the container relating both to the discharge zone, and to the articulation of the side walls to the base wall.

FIG. 11 shows the contact zone between the roof 12 and listel 52. A sealing strip 56 is interposed between the matching surfaces of the two walls, fixed to the listel 52 by means of a metal strap 58 and a fixing screw 60. Numeral 62 indicates a rainproofing lip cooperating with a guard 64 on the roof 12.

FIG. 12 illustrates the conjunction of the roof 12 with the side wall 16, formed by means of a listel 66 rigid with said wall 16 and forming with the latter an angle of 90°. The presence of said listel enables the folding of the roof onto its supporting side wall 14 during the folding down of the container. Numeral 68 indicates a safety plate arranged in such a manner as to avoid accidental falling of the roof when, during erection operations, the operator has to enter the container to close the end walls, also if the roof is supported by a crane during this stage.

FIGS. 13 to 16 illustrate together the system of discharge from the container of bulk material of small pieces.

In this respect it is to be noted that the base wall of the container of the present invention has its strengthening frame of a considerable height, such that in the end members 24 of the frame are fashioned discharge portholes 26 fitted with shutters. There is an external shutter 70 removably fixed to end member 24 and locked by a lever system of the type indicated by 72 in FIG. 13. Said shutter is ensured a perfect tight fit by means of a seal 74 (FIG. 14), thus preventing the bulk material from flowing out. In the part of the member 24 within the container a gate 76 is placed (FIG. 15), in sliding fashion and capable of being operated from the outside by means of an operating rod 78. Said gate 76 restrains the greater part of the bulk material. Chutes 80 formed on the base wall 10 of the container in correspondence with the discharge portholes promote the flowing out of the bulk material.

The operations, therefore, for the discharge of the said bulk material are as follows, one after the other:

- removal of discharge shutter 70;
- connecting the porthole with a hose (not shown) of a vacuum system for conveying the bulk material,
- opening of the sliding gate 76, by means of the operating rod 78, thus enabling the flow of material,
- tilting the container to assist the flowing out of the material, said flowing out being made easier by chutes 80.

In the case where the material is enclosed in a large sack of plastics material, polyethylene for example, the vacuum system hose is suitably fitted with a sharpened extension designed to cut the containing sack. Said sack may also be fitted with openings in correspondence with the discharge portholes.

Figure 17:
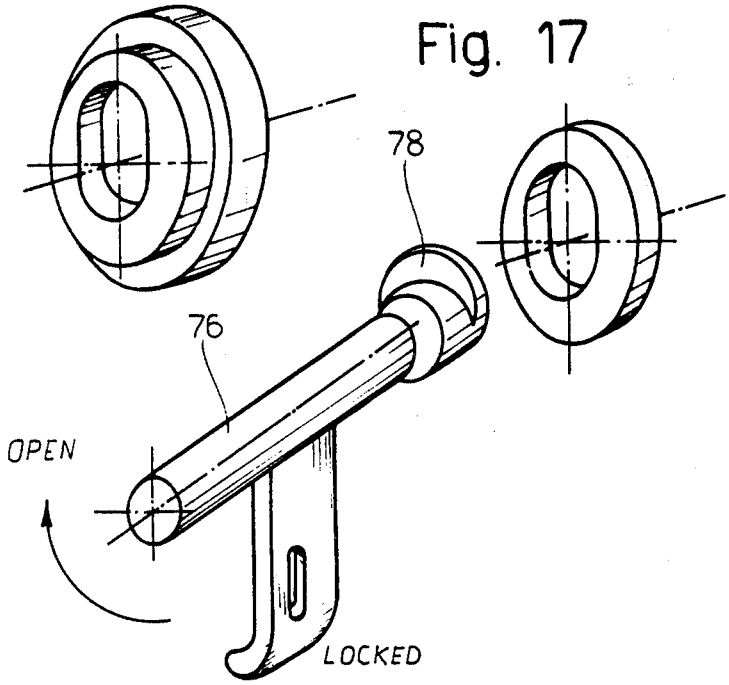
FIG. 17 illustrates the locking coupler for the walls.

Clamping of end walls 18 to the side walls 14 and 16, as also the connection between the latter and the roof 12, may be effected by means of a bolt 76 with an excentric catch 78, illustrated in FIG. 17, designed to ensure the desired compression of the sealing strips and also fitted with a nose or wedge designed to forcibly press together the said walls.

Conveniently, the container of the present invention is constructed of metallic material.

We claim:

1. A rigid collapsible container of parallelepipedic form, having a rectangular base wall, a roof, a pair of side walls and a pair of end walls, comprising:

- the said rectangular base having a peripheral strengthening frame and provided at each of its four angles with a basic upright section terminating at its upper end with a rest surface on which, when the container is erected, an extension upright carried by the corresponding side walls come to rest in vertical alignement;
- the two end walls hinged to opposite vertical edges of one of the side walls;
- the said roof hinged at one of its longitudinal edges to the said one of the side walls by hinges carried by a longitudinal listel rigid with the said one of the side walls and forming with the latter an angle of 90°, the width of said listel being not less than the thickness of the end walls, the roof also disengageably coupled in erected condition of the container to the other side wall, by means of a longitudinal listel rigid with said other side wall and forming with the latter an angle of 90°;
- the side wall hingeably carrying the end walls and the roof being hinged to the base at a height less than that of the hinge of the said other side wall, the difference in height being not less than the thickness of the upright;
- the structural relationship of the walls and roof of the container providing systematic container collapsing means wherein folding down of the erected container is only possible by the following successive operations:
- folding of the end walls inwardly onto the side wall to which they are hinged,
- folding the roof downwardly onto said folded end walls,
- folding downwardly onto the base wall the said side wall together with the end walls and with the roof folded onto the side wall itself,
- folding the other side wall downwardly onto the first one, all the folding movements involving a rotation of 90° and being carried out towards the inside of the container.

2. Container according to claim 1, wherein the said strengthening frame comprises apertures in its longitudinal members for the passage of the fork of a lifting truck and wherein the short sides of the frame are provided with portholes for the discharge of the bulk material, the portholes being equipped with shutters actuated from the outside of the container.

* * * * *